US008424230B2

(12) United States Patent
Boyer

(10) Patent No.: US 8,424,230 B2
(45) Date of Patent: Apr. 23, 2013

(54) CHANNEL SIGN ASSEMBLY AND RETAINING TRIM CAP

(76) Inventor: Clyde H. Boyer, Concord, OH (US)

( * ) Notice: Subject to any disclaimer, the term of this patent is extended or adjusted under 35 U.S.C. 154(b) by 0 days.

(21) Appl. No.: 13/313,655

(22) Filed: Dec. 7, 2011

(65) Prior Publication Data

US 2012/0192470 A1 Aug. 2, 2012

Related U.S. Application Data

(60) Provisional application No. 61/437,900, filed on Jan. 31, 2011.

(51) Int. Cl.
*G09F 13/28* (2006.01)

(52) U.S. Cl.
USPC ..... 40/551; 40/574

(58) Field of Classification Search ..... 40/781, 40/574, 552
See application file for complete search history.

(56) References Cited

U.S. PATENT DOCUMENTS

| | | | | | |
|---|---|---|---|---|---|
| 1,697,501 | A * | 1/1929 | Gast | 40/552 |
| 1,721,918 | A * | 7/1929 | Meyercord | 40/624 |
| 2,141,955 | A * | 12/1938 | Lang | 40/618 |
| 3,254,436 | A * | 6/1966 | Bank | 40/552 |
| 3,579,886 | A * | 5/1971 | Hughes | 40/773 |
| 3,760,552 | A * | 9/1973 | Skoetsch | 52/578 |
| 3,988,846 | A * | 11/1976 | Kuhling | 40/757 |
| 4,024,658 | A * | 5/1977 | Hoerner | 40/552 |
| 4,097,632 | A * | 6/1978 | Minogue et al. | 428/130 |
| 4,796,170 | A * | 1/1989 | Pedersen et al. | 362/308 |
| 6,481,132 | B1 * | 11/2002 | Grate et al. | 40/575 |
| 6,748,686 | B2 | 6/2004 | Grate et al. | |
| 7,181,875 | B2 * | 2/2007 | Lewis | 40/551 |

* cited by examiner

*Primary Examiner* — Casandra Davis
(74) *Attorney, Agent, or Firm* — Fay Sharpe LLP

(57) ABSTRACT

A channel sign assembly is provided having a rear surface for mounting against a raceway, wall, or a structure for supporting the signage, and sheet metal sides which define the figuration of the sign assembly or shape to be depicted. A lighting element is positioned against the rear surface of the enclosure, and a lens is retained to the open front of the enclosure. The lens is retained by a screw-less retainer cap secured to the sign assembly.

4 Claims, 8 Drawing Sheets

CHANNEL SIGN ASSEMBLY AND RETAINING TRIM CAP

The present invention claims priority on Patent Application Ser. No. 61/437,900, filed Jan. 31, 2011 which is fully incorporated herein by reference.

BACKGROUND

Channel sign assemblies are used to provide signage for buildings, shopping malls, and the like where it is desirable that the signage comprise illuminated letters or any other shapes that are easily seen, even at great distances, day or night. Each channel sign assembly comprises an enclosure, usually a metal box, having a rear surface which is positioned against a raceway, or the wall of a building. The channel sign assemblies further comprise signage which is mounted along a plurality of sides which define the figuration of a letter, number, etc. The letters or numbers can comprise a lens which makes up a front portion or front wall of the sign. A light source, such as a neon tube or LED lights, is positioned within the walls of the enclosure and attached proximal to the rear surface to provide illumination (of the lens) for the channel sign assembly.

The light sources used in existing channel sign assemblies that comprise neon bulbs or tubes require high voltage power with transformers built into the metal enclosures. To prevent injury to those servicing such channels sign assemblies many municipalities require that such sign assemblies be inspected to ensure that they are adequately sealed using standards set by the Underwriters Laboratories (UL).

The light sources used in existing channel sign assemblies that comprise low voltage LED type light sources provide a very long lasting bright light without requiring the high voltage and transformers needed for neon lighting. It is expected that channel sign assemblies employing the LED type light sources will not be required to meet the same standards set by the UL for neon tubes, but rather other (i.e. less onerous) standards.

In addition to the lighting, the channel sign assembly can also include a planar transparent or translucent lens, the outer shape of which corresponds to the figuration of the sign assembly or any other shape defined by the sides of the enclosure. The lens of existing channel sign assemblies have a trim cap glued to the outer edges thereof which form a border around the lens. The trim cap, heretofore developed, also has a lip which when assembled to the enclosure, is shaped to fit around the forward ends of the walls thereof for retaining the lens to the enclosure and for maintaining the water resistant seal required by the UL. Screws are threaded through the sides of the trim cap and into the metallic walls in order to retain the lens and trim cap across the forward opening of the enclosure.

SUMMARY

The present disclosure is embodied in a channel sip assembly. For the purposes of this description, a channel sign assembly is defined as an illuminated contoured fixture in the shape of a letter of the alphabet, a numeral, an element of punctuation such as a comma, an exclamation point, or any other shape or form intended to constitute a portion of a sign.

The channel sign assembly of the present disclosure has a rear surface for mounting against a raceway, a wall, or any other structure suitable for supporting the signage. The walls defining the figuration of the sip assembly or shape to be depicted can be made of sheet metal having a given thickness.

A lighting element, such as a strip of LEDs according to the newly available technology or any other light source, can be positioned against the rear surface of the enclosure to provide illumination therefore.

To retain the lens to the open front of the enclosure, a shoulder can be provided around the inner surface of the sides thereof wherein the shoulder defines a plane parallel to the outer ends of the side walls but is recessed therefrom. In accordance with the present disclosure, a planar transparent or translucent lens having an outer edge which is in the shape of the sign assembly and sized to fit within the side walls of the enclosure is retained against the shoulder by retainer cap and a plurality of retaining tabs which are intermittently spaced around a forward end of the sheet metal side walls.

In accordance with the present disclosure, a channel sign assembly is provided comprising an enclosure having at least two opposing walls made of sheet metal or similar. The at least two opposing walls define the shape of the sign wherein the sign has an open front. The at least two opposing walls have an inner surface and a forward end. The walls include a series of intermittent tabs punched outward through the walls, wherein the tabs are aligned with and offset from the forward end. The assembly further comprises a planar transparent lens having a forward surface. The lens includes an outer edge in the defined shape of the sign and is sized to fit within the at least two opposing walls of the enclosure. A retainer cap is provided and mounted against the forward surface of the lens for retaining the lens within the enclosure and against the walls. The retainer cap comprises an extrusion readily formable into a variety of shapes. The retainer cap includes an interior face having a first edge and an opposing second edge. The first edge has an overhang welded to the forward surface of the lens; and, the second edge has a channel, wherein the channel is adapted to securely engage a plurality of the tabs along an outer surface of the enclosure walls.

In accordance with the present disclosure, the tabs can be spaced intermittently and aligned along the forward end of the metal walls of the enclosure for securing and retaining a retainer cap. The retainer cap can include an extrusion readily formable into a variety of shapes. The retainer cap can include an interior face having a first edge and an opposing second edge. The first edge can include an overhang welded to the forward surface of the lens, and the second edge can have a channel wherein the channel is adapted to securely engage a plurality of the tabs along an outer surface of the enclosure walls.

BRIEF DESCRIPTION OF THE DRAWINGS

A better and more complete understanding of the present disclosure will be had after a reading of the following detailed description taken in conjunction with the drawings wherein.

DETAILED DESCRIPTION

The subject embodiments to follow relate to channel sign assemblies and related store front signs, especially those that are illuminated by neon or LED and the like, and include selective wording identifying the store by name or can include other descriptive figurations or shapes. The embodiments have particular applications to sign installation systems that are simple and quick to install and maintain, by including a wide variety of figurations.

As discussed above, signs fabricated with plastic faced letters for disposition within a lighted channel to create a three dimensional illuminated sign are well known. A product often referred to as trim cap in the sign industry, can be used for securing the plastic faced letters to the lighted channel. The trim cap can be manufactured by extruding essentially a thin flat strip 1 inch to 2 inches wide of vinyl plastic that has been embedded with a metallic foil for strength and formability.

Trim cap can come in rolls and may be cut to any length. It can essentially be shaped to any figuration or size and is used to trim Plexiglas® letters or shapes by chemically welding the trim to the plastic shapes. The letters or shapes can then be placed on a channel which would contain neon or LED lighting to illuminate the letters or shapes. The result is a three-dimensional illuminated letter or shape. Prior attachment means for securing the trim cap to the outside of the metallic channel comprises holes drilled through the trim cap and the metal channel followed by screws driven through the trim cap into the metallic channel (i.e. for securing the trim cap thereto).

Figure 1:
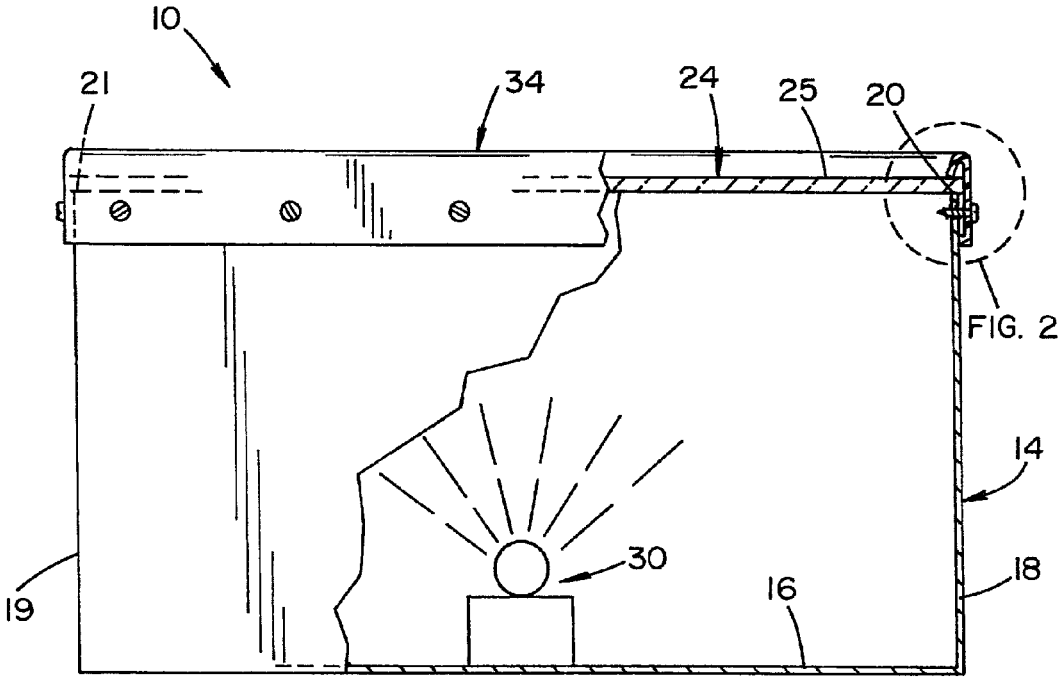
FIG. 1 (PRIOR ART)
FIG. 1 is a front elevational view of a prior art channel sign assembly.
Figure 2:
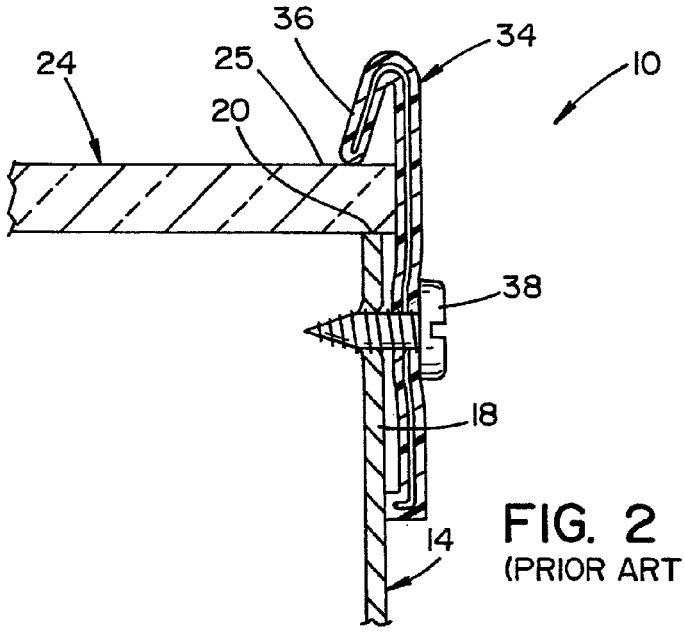
FIG. 2 (PRIOR ART)
FIG. 2 is an enlarged cross sectional view of the channel sign assembly shown in FIG. 1.

Referring to FIGS. 1 and 2, a channel sign assembly 10 according to the prior art is mounted on a supporting structure (not shown). The channel sign assembly 10 includes a metal enclosure 14 having a rear surface 16 and a plurality of side walls 18, 19 which are contoured to define the edges of a sign assembly 10. The forward edges 20, 21 of the sidewalls 18, 19 define a plane and fitted across the forward edges 20, 21 is a transparent lens 24 having a shape corresponding to that defined by the walls 18, 19 of the enclosure 14. Retained to the rear surface 16 of the enclosure 14 is a light source 30, which can extend through the length of the channel sign assembly 10 and thereby illuminate the entire surface of the lens 24.

Referring further to FIG. 2, in accordance with the prior art, the lens 24 is retained to the side walls 18, 19 of the enclosure 14 by the trim cap 34, a plastic border member which can be glued or welded to the outer edges of the lens 24. The trim cap 34 has a rearwardly extending lip 36 that fits over the forward edges 20, 21 of the side walls 18, 19 and the lens 24. The assembly is then secured to the enclosure member 14 by a plurality of screws 38.

The use of screws 38 is undesirable for a number of reasons. Screws 38 are not aesthetically acceptable and they create depressions in the trim cap. The screws 38 peel when painted to match the trim cap and can rust and freeze making it difficult to remove for servicing the sign assembly. The screws 38 cause staining and often crack the trim cap. Thus, there is a need for an improved system for assembling trim cap letters and numbers to a supporting channel.

The manufacture of a channel sign assembly 10 involves the construction of the enclosure 14, the manufacture of a light fixture 30 and the lens 24. Manufacture of the lens 24 involves cutting a transparent acrylic material into the shape of the channel sign assembly 10 and attaching the trim cap 34 around the edges thereof. The trim cap 34 can be welded to the outside plastic face 25 of the lens 24 using chemical bonding material, for example, Rez-N-Bond. The trim cap 34, heretofore developed, is intended to meet the present sealing standards set by Underwriters Laboratories, but the same such standards may not be needed for channel sign assemblies which employ the new LED technology. It would, therefore, be desirable to provide an easier and less expensive method of attaching/detaching/reattaching a lens 24 and trim cap 34 to the enclosure of the channel sign assembly 10.

Referring to FIGS. 3-6, a channel sign assembly 100 in accordance with the present disclosure can be attached to a supporting structure and includes a metallic enclosure 114 having a rear surface (not shown) and a plurality of sheet metal side walls 118, 119 similar to the prior art. Fitted within the enclosure 114 is a suitable light source (not shown). A retainer or snap cap 134 can be attached, i.e. firmly glued to the lens 24. The lens 24 and retainer cap 134 provide lateral support to the walls 118, 119. After assembly, the lens 24 and the retainer cap 134 prevent the walls 118, 119 from moving towards each other and from bowing outward away from each other.

With reference again to FIGS. 3-6, the system for fabricating and installing a retainer cap 134 without screws is shown. A tool 200 (FIGS. 7-9) can punch, cut, and bend a tab 140 outward away from the outside surface or wall 118 of the channel enclosure 114 as shown in FIGS. 3-6. In exemplary embodiments, the tab 140 can be from about ¼" to about ½" long and from about ¼" to about 1" wide. The lower edge 144 of the tab extends outward away from the wall of the channel and can engage a foot 150 of the retainer cap 134 (i.e. in a 'snap cap' or friction engagement arrangement). The foot 150 of the retainer cap 134 can be in the form of a receiver edge 152 angled from about 4 degrees to about 9 degrees 151 from a horizontal plane 153 perpendicular to a vertical plane 154 comprising a leg 156 of the retainer cap 134. In one arrangement, the receiver 152 can be angled from about 5 degrees to about 7 degrees 151 from the horizontal plane 153.

Figure 5:
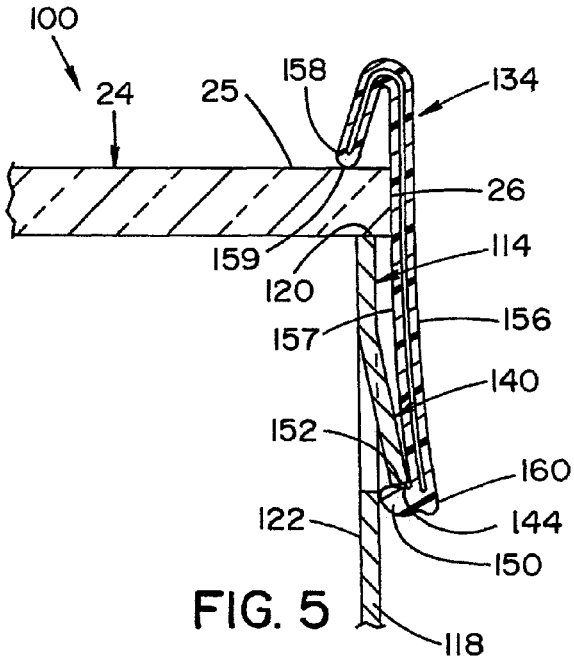
FIG. 5 is an enlarged cross sectional view of the mounting of the lens to the enclosure shown in FIG. 4 employing the retainer cap (after attaching the retainer cap to the enclosure)

The tabs 140 can be punched into the channel walls 118, 119 at random positions around the letter or shape at the discretion of an installer. The number and intermittent spacing of the tabs 140 will be dependent upon the size and design of the channel sign 100. Referring to FIG. 5, the interlocking effect of the foot 150 of the retainer cap 134 to the lower edge 144 of the tabs 140 will enable secure attachment of the plastic lens 24 and retainer cap 134 to the metallic channel enclosure 114 (without the use of screws, et al.).

Figure 3:
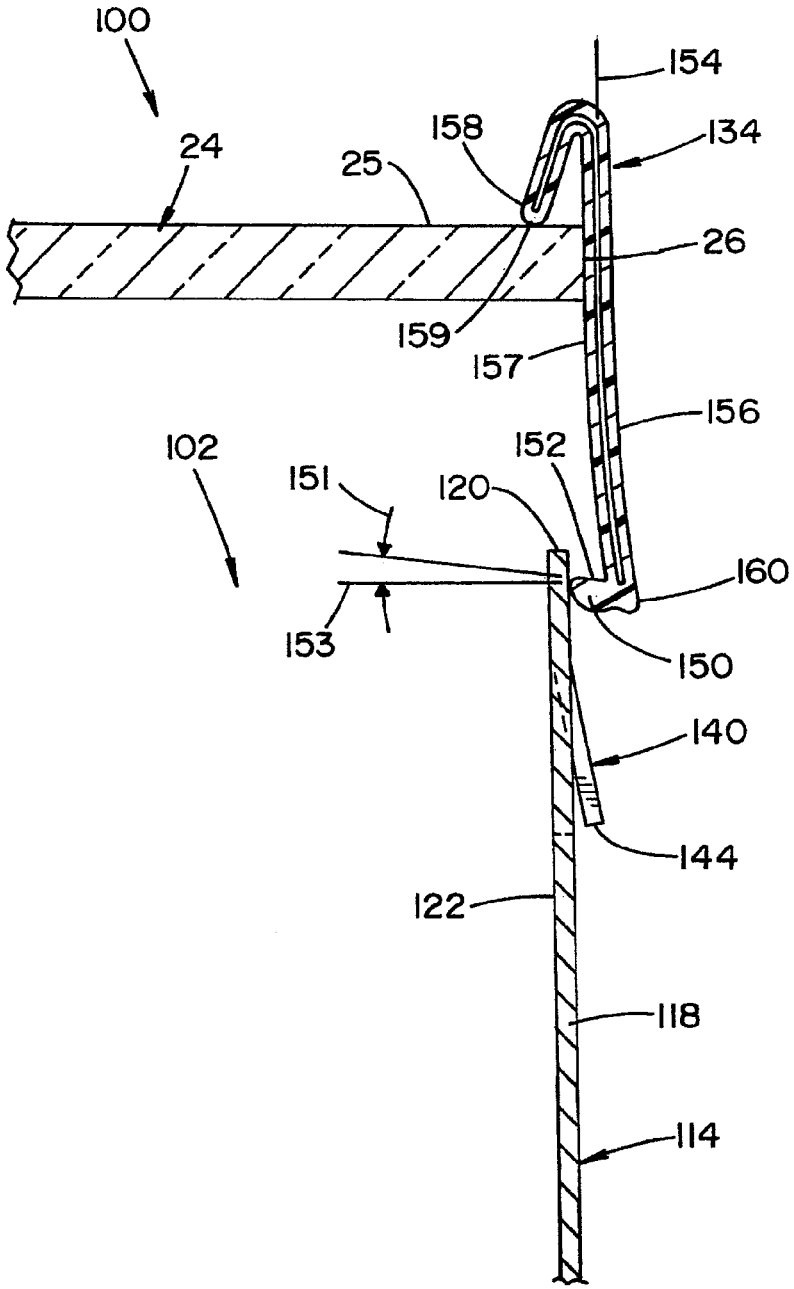
FIG. 3 is an enlarged cross sectional view of a channel sign assembly in accordance with the present disclosure.
Figure 4:
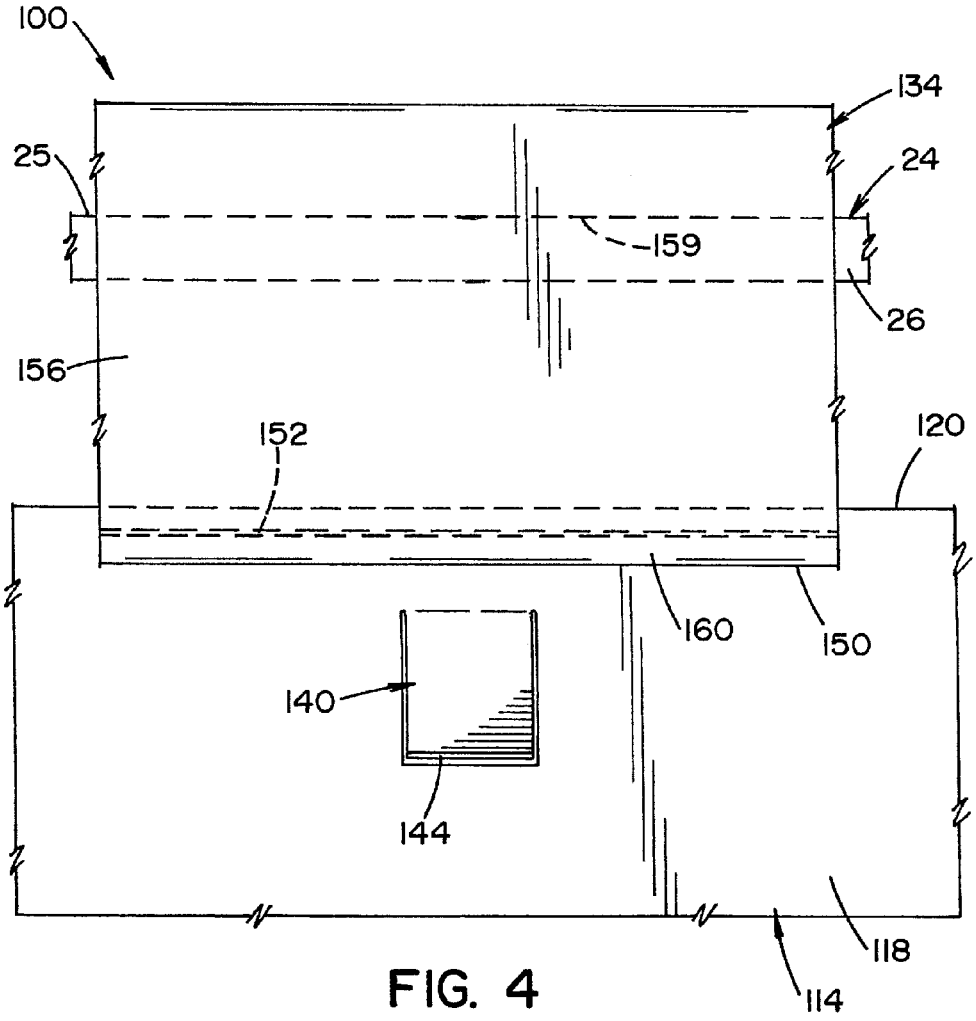
FIG. 4 is an elevational view of the channel sign showing the retainer cap and channel sign enclosure (prior to attaching the retainer cap to the enclosure)
Figure 6:
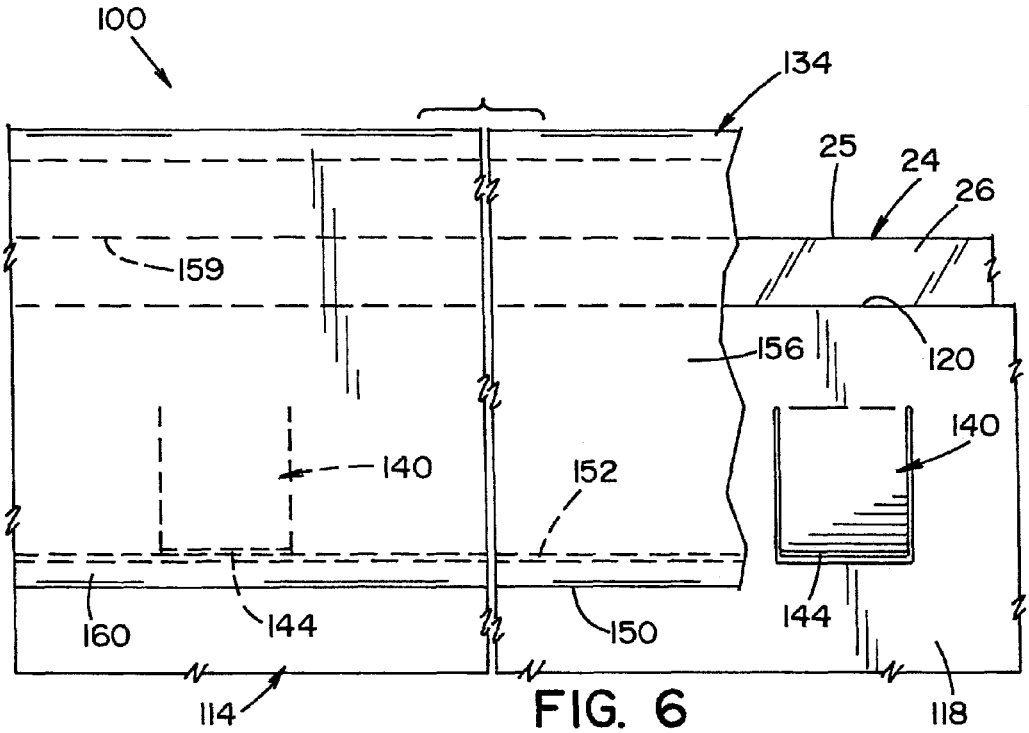
FIG. 6 is a side view of the retainer cap and enclosure shown in FIG. 5.

The punch tool 200 (FIGS. 7-9) can be utilized in order to accomplish and create the tabs 140 for securing the retainer cap 134 to the metallic walls 118, 119. The tool 200 can punch, cut, and bend the tabs 140 to any desired size to the outside surface of the channel walls 118 as shown in FIGS. 3-6. The lower edge 144 of the tab can engage the second edge 152 and foot 150 of the retainer cap 134 (i.e. in a snap or friction fit arrangement). As discussed, the tabs 140 can be punched along the channel walls 118 at predetermined spaced positions, while aligning with the forward edge 120 of the metallic walls 118, around the letter or shape. The interlocking effect enables a positive engagement of the plastic retainer cap 134 to the forward edge 120 and forward side portions 118 of the metallic enclosure 114. FIG. 3 shows a side view of the tab 140 as it would be aligned with the front edge 120 of the side walls 118. FIG. 6 shows an elevational view of a side wall 118 of a formed sign assembly shown with a tab 140 extending from the side wall.

Figure 7:
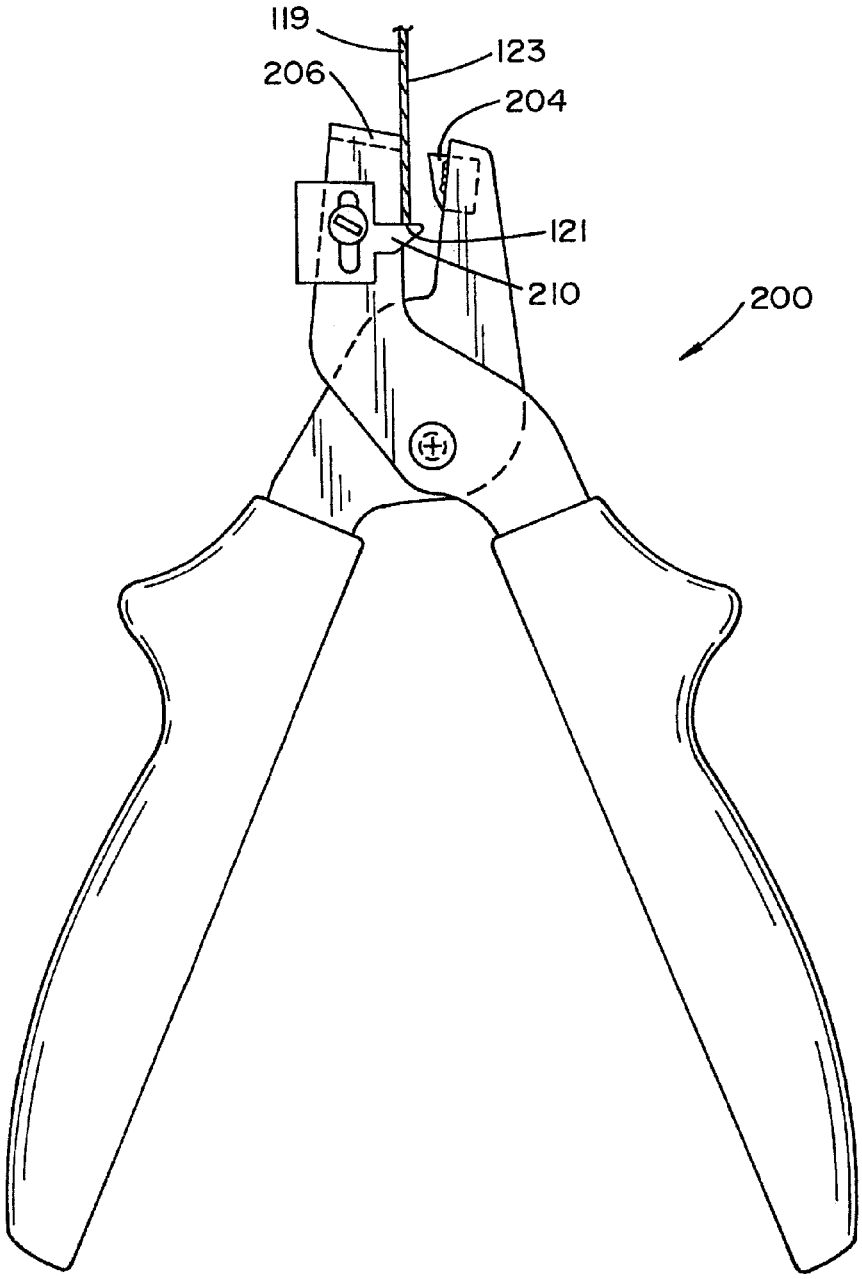
FIG. 7 is an elevational view of a punch tool in accordance with the present disclosure.
Figure 8:
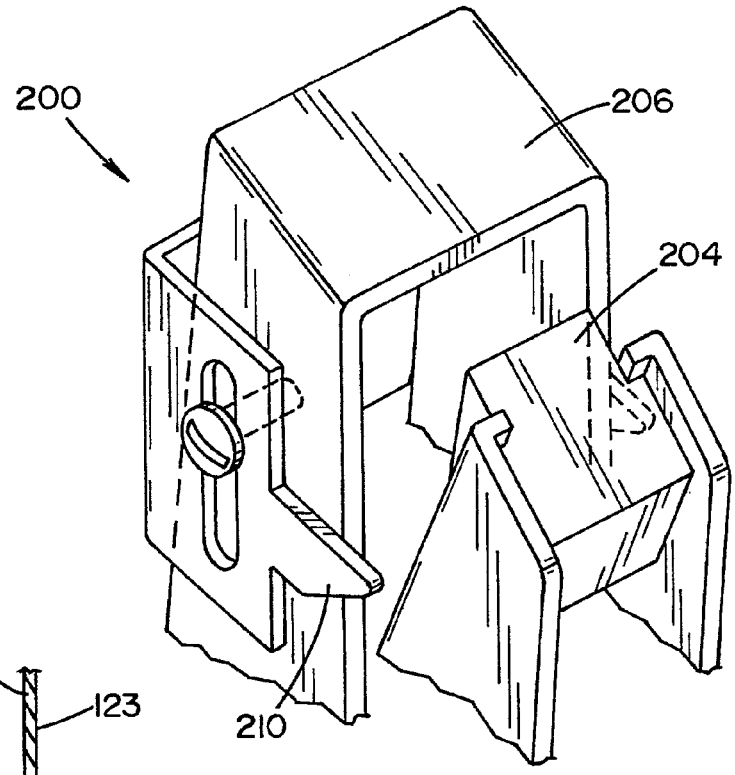
FIG. 8 is a further enlarged perspective view of the punch tool.
Figure 9:
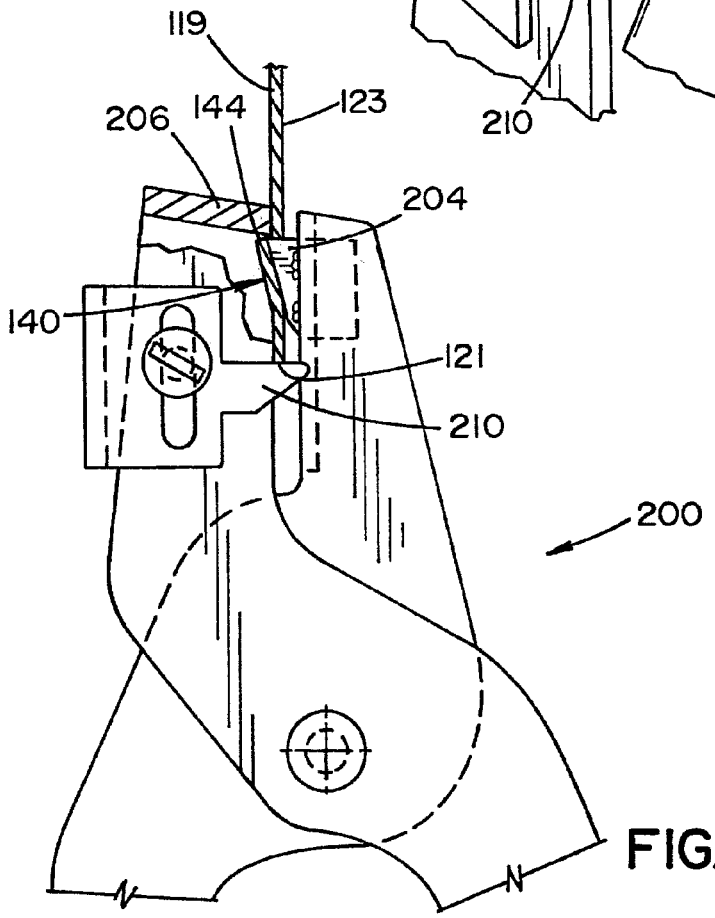
FIG. 9 is a fragmentary enlarged side view of the punch tool in operation.
Figure 10:
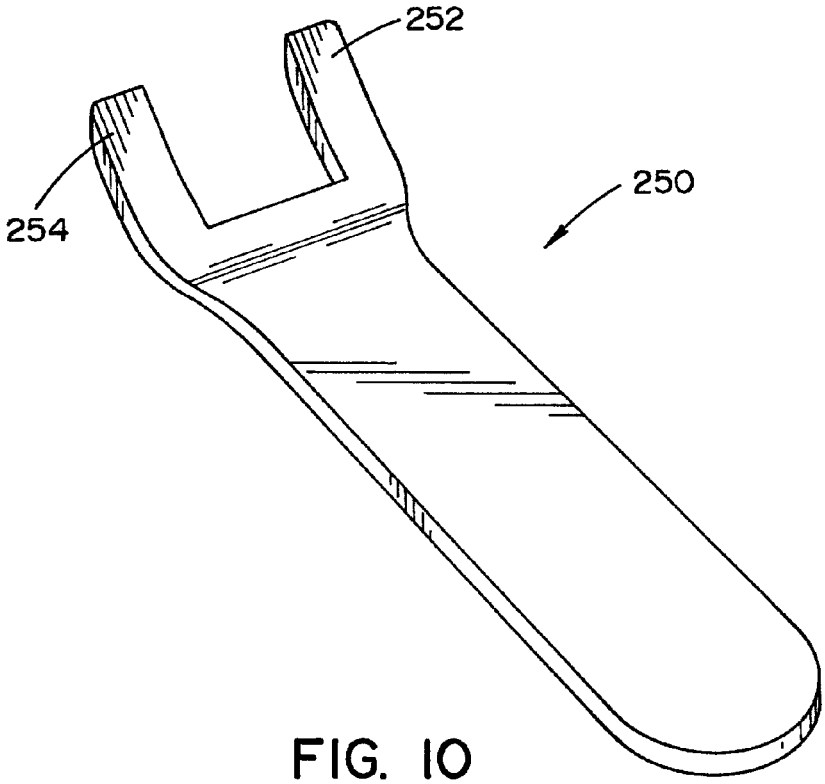
FIG. 10 is a perspective view of a second tool for detaching the retainer cap from the enclosure in accordance with the present disclosure; and, FIG. 11 is an enlarged view for channel sign assembly with the second tool detaching the retainer cap from the enclosure.

Referring now to FIGS. 7-9, the punch tool 200 can comprise a male component 204 and a female component 206 wherein the male component 204 is adapted to cut tabs 140 from the channel side walls 118, 119 and bend the tabs 140 outward at an angle away from the side walls 118, 119 as the male component 204 is pushed through the open channel of female component 206. The tabs 140 can be positioned such that they are proximal to the front edge 120, 121 of the side walls 118, 119 and aligned with the front edge 120 of the side walls 118. The tool 200 can include a stop 210 which provides the offset for aligning and spacing the tabs 140 parallel to the forward end 120 of the side walls 118. The punching of the tabs 140 can be done by the manual tool 200 or can be incorporated into a pneumatic punch press (not shown) as part of an automated channel letter forming machine.

In furtherance of the above described retainer cap 134, another tool 250 has been developed to facilitate the detachment or removal of the plastic retainer or snap cap 134 from the metallic walls 118, 119. The retainer cap 134 can be detached from the tabs 140 using this separate tool 250 which can be manually lever driven. The lever tool 250 includes a pair of prongs 252, 254 for prying underneath the foot 150 of the retainer cap 134 to detach the attached portion of the retainer cap 134 from the tab 140. The lever tool 250 can release the retainer cap much as a bottle opener locks under the lid to pop a lid off.

Figure 11:
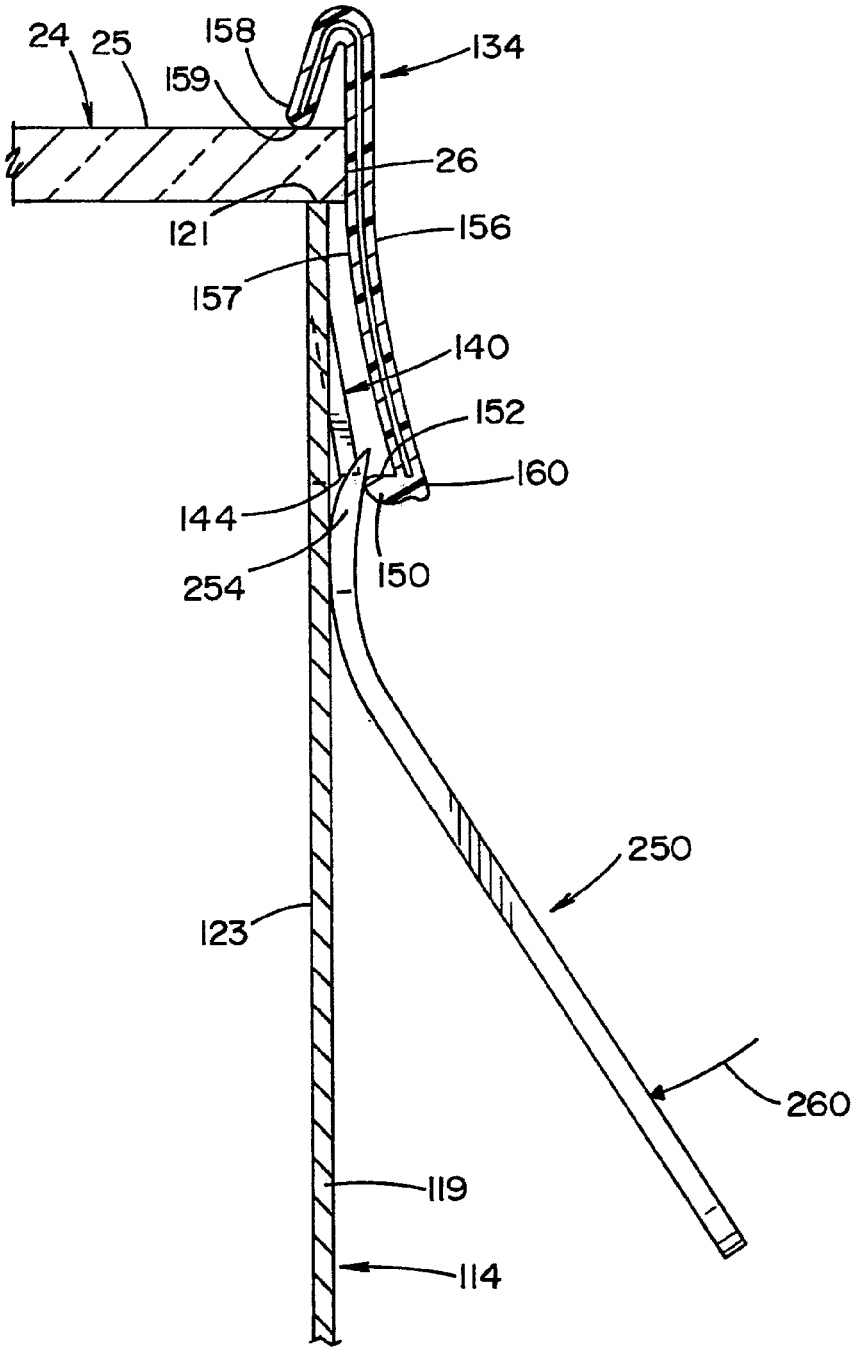

When a channel sign assembly 100 is assembled using the tabs 140 as described, the finished product will present a more attractive appearance than one assembled using screws. In addition, when it is time to service the sign assembly 100 to replace LEDs, or other devices, the snap/retainer cap 134 can be pried off using the simple lever device 250, via movement of the lever in the direction 260 shown in FIG. 11. The lever device 250 can reach between the retainer cap 134 and the side wall 118 which then enables pulling of the receiver edge 152 of the retainer cap 134 outward in order to free the edge 152 from the terminal end 144 of the tab 140. This prying process can be continued for several tabs which will allow the service technician to free the entire perimeter, or a desired portion thereof, of the retainer cap 134 from the forward end 120 of the channel sign enclosure 114 without the use of a screwdriver and the cumbersome removal of screws.

In accordance with one embodiment of the aforementioned disclosure, the channel sign assembly 100 comprises the enclosure 114 having at least two opposing walls 118, 119 made of sheet metal. The enclosure 114 defines the shape of the sign assembly 100 wherein the sign has an open front 102. The at least two opposing walls 118, 119 have an inner surface 122, 123 and forward ends 120, 121, respectively. The walls 118, 119 include a series of intermittent tabs 140 punched outward through the walls 118, 119, wherein the tabs 140 are aligned with and offset from the forward ends 120, 121. The assembly 100 further comprises a planar transparent or translucent lens 24 having a forward surface or outside face 25. It is to be appreciated that the lens 24 includes an outer edge 26 in the defined shape of the sign and is sized to fit within or adjacent to the at least two opposing walls 118, 119 of the enclosure 114. A retainer cap 134 can be mounted against the forward surface 25 of the lens 24 for retaining the lens 24 with the enclosure 114 and against the walls 118, 119. The retainer cap 134 can include an interior face 157 having upper or first edge 158 and an opposing lower or second edge 160. The first edge 158 has an overhang 159 welded to the forward surface 25 of the lens 24; and, the second edge 160 has the foot or channel 150, wherein the channel 150 and receiver edge 152 is adapted to securely engage a plurality of the tabs 140 along an outer surface of the enclosure 114.

In accordance with another embodiment of the aforementioned disclosure, a method is provided for forming the channel sign assembly 100. The method comprises making an enclosure 114 with at least two opposing walls 118, 119 made of sheet metal or similar. The walls 118, 119 can be bent to any figuration and will form the enclosure 114 which in turn will define the shape of the sign assembly 100. The enclosure 114 can have an open front 102. The at least two opposing walls 118, 119 will have inner surfaces 122, 123 and forward ends 120, 121, respectively. The method further provides for a tool 200 used for punching a series of intermittent tabs 140 through the walls 118, 119, such that the tabs protrude outward and are aligned with and offset from the forward ends 120, 121 of walls 118, 119. The method further comprises cutting a lens 24 to fit within or adjacent to, the at least two opposing walls 118, 119 of the enclosure 114. A retainer cap 134 that has been cut to length can be mounted against the forward surface 25 of the lens 24 for retaining the lens 24 to the enclosure 114 and against the walls 118, 119. The retainer cap 134 comprises an interior face 157 having upper or first edge 158 and an opposing lower or second edge 160. The first edge 158 has an overhang 159 that can be welded to the forward surface 25 of the lens 24; and, the second edge 160 has the foot or channel 150, wherein the channel 150 and receiver edge 152 is adapted to securely engage a plurality of the tabs 140 along an outer surface of the enclosure walls 114. The retainer cap 134 can be 'snapped' into position by pressing the foot 150 over the terminal edges 144 of the respective tabs 140. This step can be repeated around the entire circumference of the enclosure 114, thereby securing the lens 24 and retainer cap 134 to the walls of the enclosure 114. Another tool 250 can be used for detaching the retainer cap 134 from the enclosure 114 (see FIG. 1)) in order to remove the retainer cap 134 for servicing the lights (or other maintenance) within the enclosure 114.

While embodiments of the present disclosure have been disclosed, it will be appreciated that many modifications or variations may be made without departing from the true spirit and scope of the disclosure. It is, therefore, the intent of the pending claims to cover all such variations and modifications which fall within the true spirit and scope of the disclosure.

What is claimed:

1. A channel sign assembly comprising:

an enclosure having at least two opposing walls made of sheet metal, said at least two opposing walls defining the shape of said sign and having an open front;

said at least two opposing walls having an inner surface and a forward end;

said walls including a series of intermittent tabs punched outward through said walls, wherein said tabs are aligned with and offset from said forward end;

a planar transparent lens having a forward surface, and an outer edge in said defined shape of said sign and sized to fit within said at least two opposing walls of said enclosure;

a retainer cap against said forward surface of said lens for retaining said lens within said enclosure and against said walls;

said retainer cap comprises an extrusion readily formable into a variety of shapes;

said retainer cap includes an interior face having a first edge and an opposing second edge;

said first edge having an overhang welded to said forward surface of said lens; and, said second edge having channel, wherein said channel adapted to securely engage a plurality of said tabs along an outer surface of said enclosure walls.

2. A channel sign assembly in accordance with claim 1, wherein said enclosure has a rear surface, and said inner surface of said walls extending without interruption from said rear surface to said tabs.

3. A channel sign assembly in accordance with claim 2, wherein said channel of said second edge includes a receiver adapted to receive said plurality of tabs, wherein said receiver is positioned at an angle from about 4 degrees to about 7 degrees from a horizontal plane wherein said horizontal plane is substantially perpendicular to a leg of said retainer cap.

4. A channel sign assembly in accordance with claim 3, said receiver includes partially flexible material extending inwardly from said interior face wherein said tabs will wedge between said receiver and said interior face of said retainer cap when said retainer cap is fitted against said enclosure walls.

* * * * *